US006885271B1

(12) United States Patent
Shimoide et al.

(10) Patent No.: US 6,885,271 B1
(45) Date of Patent: Apr. 26, 2005

(54) INTEGRATED COIL SUPPORTING UNIT SLIDABLY HOLDING IGNITION COIL UNITS

(75) Inventors: Yoshihiro Shimoide, Chita-gun (JP); Shigemi Itou, Toyota (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/779,778

(22) Filed: Feb. 18, 2004

(51) Int. Cl.[7] ..... H01F 27/02
(52) U.S. Cl. ..... 336/90; 123/634; 123/635
(58) Field of Search ..... 336/65, 83, 90–96, 336/107, 192; 123/634–635

(56) References Cited

U.S. PATENT DOCUMENTS 5,109,828 A * 5/1992 Tagami et al. ..... 123/635
6,543,430 B2 * 4/2003 Moga et al. ..... 123/634
6,622,711 B1 * 9/2003 Skinner et al. ..... 123/634
6,675,786 B2 * 1/2004 Tsunenaga et al. ..... 123/635
6,776,147 B2 * 8/2004 Tsunenaga et al. ..... 123/635

FOREIGN PATENT DOCUMENTS

JP 9-250437 9/1997

* cited by examiner

*Primary Examiner*—Tuyen T Nguyen
(74) *Attorney, Agent, or Firm*—Nixon & Vanderhye P.C.

(57) ABSTRACT

An interesting coil supporting unit for an engine includes an elongated casing and a plurality of coil units. Each coil unit has a coil support portion and an ignition coil. The coil support portions are disposed inside the casing at predetermined intervals. The casing and the respective coil support portions are fastened to a cylinder block by means of a plurality of bolts. In this state, each coil unit is supported by the corresponding bolt so as to be slidable in its radial direction. Therefore, the coil units can be positionally slid in the casing and thereby installed easily on the engine.

10 Claims, 4 Drawing Sheets

INTEGRATED COIL SUPPORTING UNIT SLIDABLY HOLDING IGNITION COIL UNITS

FIELD OF THE INVENTION

The present invention relates to an integrated coil supporting unit for an internal combustion engine for transmitting ignition signals to a plurality of ignition coils.

BACKGROUND OF THE INVENTION

In an internal combustion engine, for example, an engine of an automobile, a plurality of spark plugs for respective cylinders is required to generate ignition sparks at predetermined time points. Therefore, an integrated coil supporting unit is employed so as to send ignition signals to respective ignition coils corresponding to the spark plugs.

In general, the integrated coil supporting unit includes an elongated casing and a plurality of coil units, which project from the casing in parallel. Each coil unit includes the ignition coil and is plugged into a corresponding one of plug receiving holes, which are formed in an engine block at predetermined pitches. The spark plug is installed at the bottom of each plug receiving hole, and each coil unit is connected to the corresponding spark plug. However, the integrated coil supporting unit, which is made by means of resin molding, is likely to be deformed after molded, so pitches among the coil units tend to vary. Accordingly, the integrated coil supporting unit generally has a structure, in which each coil unit is supported in the casing slidably in its radial direction.

For example, the above integrated coil supporting unit is shown in FIGS. 7A to 7D (JP-A-H9-250437). The integrated coil supporting unit has a connector block 100, the shape of which is platy and elongated, a plurality of connector supports 103, which are disposed on the connector block 100 at predetermined intervals, and a plurality of coil connectors 112, each of which is disposed on the corresponding connector support 112. As shown in FIG. 7C, each connector support 103 has an inlet hole 105, locking tongues 106, which are formed around the inner periphery of the inlet hole 105, a support main body 104, which has bolt holes 108, and a cylindrical wall 107, which projects downward from the support main body 104.

As shown in FIG. 7D, the coil connector 112 includes a contact portion 115, which contacts the support main body 104, a concave portion 116, a cylindrical insert portion 113, which is inlet in the inlet hole 105, and a lockable tab 114, which is locked by the locking tongues 106. At the bottom of the concave portion 116, an electrically conductive bus bar 117 is embedded. An electrically conductive terminal 118, exposed to the surface of the connector support 103, is connected to one end of the bus bar 117. Moreover, the other end of the bus bar 117 is connected to an electrically conductive terminal 119.

As shown in FIG. 7D, the coil connector 112 is engaged with the connector support 103. The coil connector 112 covers the connector support 103, and the terminal 119 is electrically connected to an ignition coil 125. In a state where the lockable tab 114 is locked by the locking tongues 106, the coil connector 112 can be slid in its radial direction on the connector support 103 with the locking tongues 106 deformed.

However, in the integrated coil supporting unit, the connector support 103 and the coil connector 112 respectively have complicated structures. Accordingly, mold tools for molding the connector supports 103 and the coil connectors 112 are required to be complicated, so the manufacturing cost is high.

Moreover, since the locking tongues 106 and the lockable tab 114 are formed thin, they are likely to be broken. Further, the ignition coil 125 is supported only by the insert portion 113. Accordingly, when the ignition coil 125 is vibrated by the engine, the ignition coil 125 and the connector support 103 are likely to be disconnected, or the insert portion 113 is likely to be broken.

SUMMARY OF THE INVENTION

In view of foregoing circumstances, it is an objective of the present invention to provide an integrated coil supporting unit, which has a simple structure and moreover can surely support ignition coils.

According to the present invention, an integrated coil supporting unit can be fastened to an engine block by means of bolts. Moreover, ignition coil units can be slidably supported on a two-dimensional plane inside a casing when being installed in the engine block.

For example, the integrated coil supporting unit includes an elongated casing and a plurality of coil units, each of which includes a coil support portion and an ignition coil. The coil support portion is integrated with the ignition coil and is supported inside the casing. The coil support portion has a through hole, and the casing has a plurality of bolt holes. Bolts are threaded into the respective bolt holes and the through holes, and moreover threadably engaged with threaded bolt holes in the connector block, so the integrated coil supporting unit is fastened to the engine block. A clearance is provided between the inner periphery of each through hole and the outer peripheral surface of the corresponding bolt. Thus, each coil unit is slidable in its radial direction on the two-dimensional plane in the manufacturing process.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PRESENTLY PREFERRED EMBODIMENTS

Preferred embodiments of the present invention will be described hereinafter with reference to the accompanying drawings.

(First Embodiment)

Figure 1:
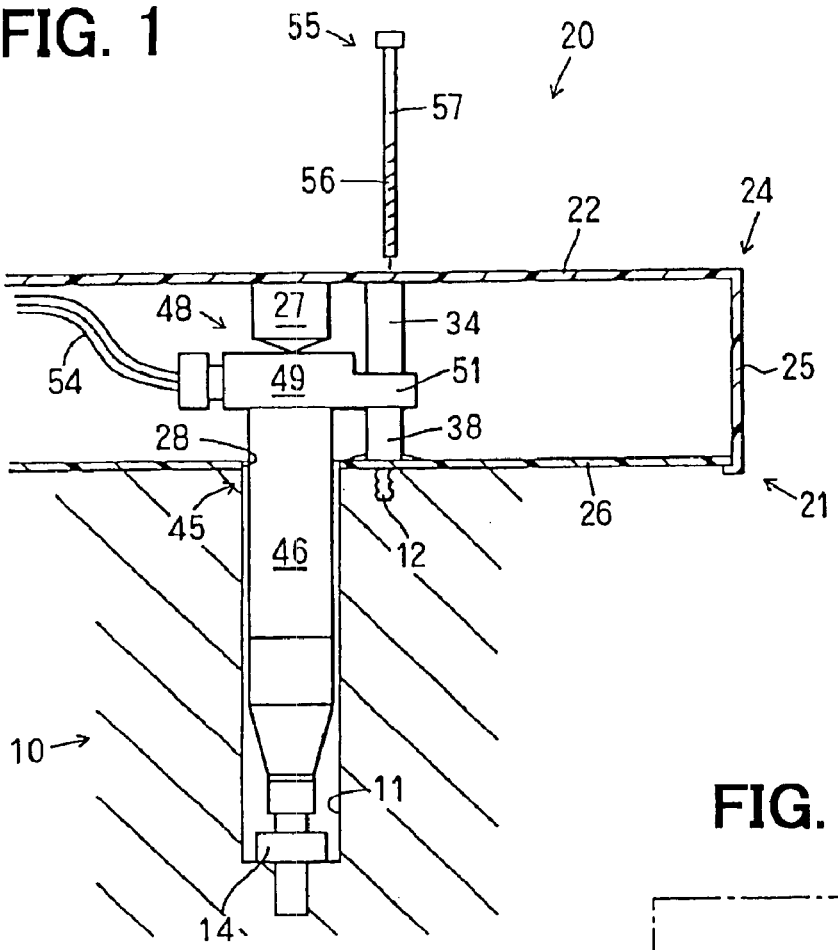
FIG. 1 is a cross-sectional view of a part of an integrated coil supporting unit according to the first embodiment of the present invention.

Referring to FIG. 1, a cylinder block 10 of a four-cylinder engine has four plug receiving holes 11 and four bolt holes 12. At the bottom of the plug receiving hole 11, a spark plug 14 is installed. An integrated coil supporting unit 20 is mounted on the cylinder block 10.

Figure 6:
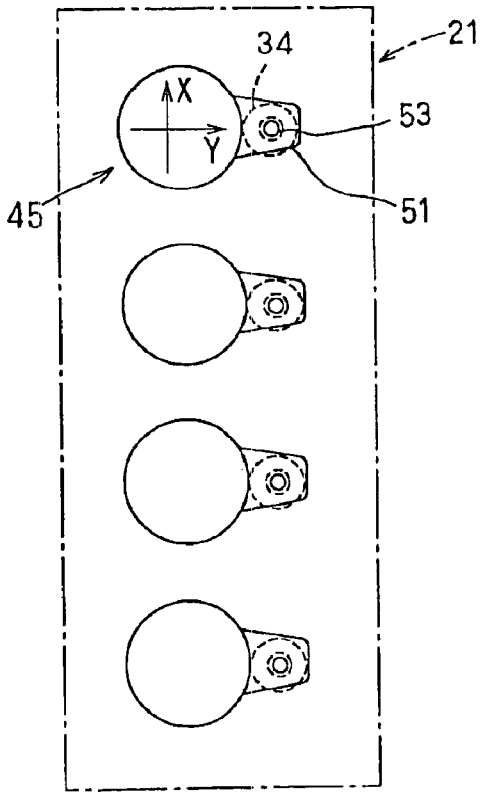
FIG. 6 is a schematic top plan view of the integrated coil supporting unit according to the present invention.

As shown in FIGS. 1 and 6, the integrated coil supporting unit 20 includes a longitudinal casing 21 and coil units 45. The coil units 45 are disposed at predetermined intervals in the casing 21 and project from the casing 21 in parallel. Moreover, the casing 21 includes a casing main body 24 and a casing cover 26. The casing main body 24 has an upper wall 22, a pair of side walls 25. For example, the upper wall 22 can be substituted by a head cover of the engine. The upper wall 22 has four projections 27, each of which is made of elastic material and projects downward. The casing cover 26 has four through holes 28, which penetrate through the casing cover 26 and respectively receive ignition coils 46.

Figure 2:
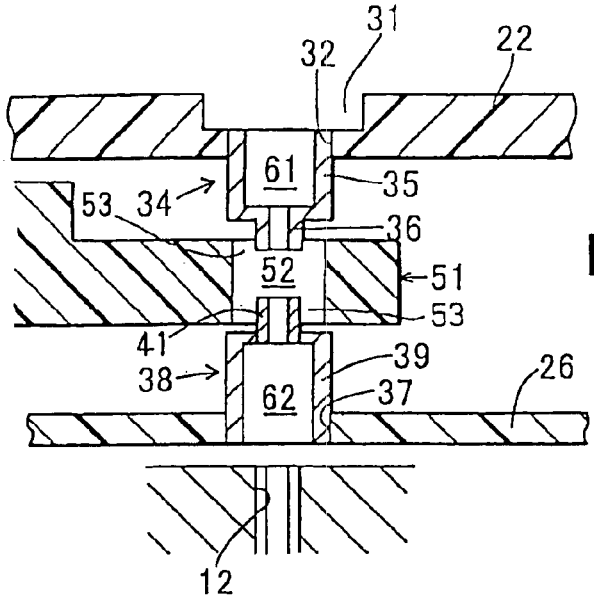
FIG. 2 is an enlarged cross-sectional view of a part of the integrated coil supporting unit shown in FIG. 1.

As shown in FIG. 2, the upper wall 22 has four round concavities 31 on its top outer surface. Each concavity 31 is positioned adjacently to the corresponding projection 27 and has a through hole 32 in its center. An upper bushing 34 is fitted in the through hole 32 so as to project downward from the upper wall 22. The upper bushing 34 includes a first cylindrical wall 35 and a second cylindrical wall 36, which is smaller in diameter than the first cylindrical wall 35.

The casing cover 26 has four through holes 37, penetrating through the casing cover 26. A lower bushing 38 is fitted in the through hole 37 so as to project upward from the casing cover 26. The lower bushing 38 includes a first cylindrical wall 39 and a second cylindrical wall 41, which is smaller in diameter than the first cylindrical wall 39. The first cylindrical walls 35, 39 have the same inner and outer diameters, and the second cylindrical walls 36, 41 have the same inner and outer diameters. The heights of the second cylindrical walls 36, 41 are so determined that the sum of the heights generally equals the thickness of the fastening portion 51. Moreover those four cylindrical walls 35, 36, 39, 41 are disposed concentrically.

As shown in FIG. 1, the coil unit 45 includes a cylindrical ignition coil 46, essentially composed of a primary coil (not shown) and a secondary coil (not shown), and a coil support portion 48 on the top of the ignition coil 46. The coil support portion 48 is elongated in a longitudinal direction of the casing 21 and includes a coil support 49 for supporting the upper end of the ignition coil 46, and a fastening portion 51, which is thinner than the coil support 49 and projects from the coil support 49. The thickness of the fastening portion 51 is substantially the same as the sum of the projecting lengths of the second cylindrical walls 36, 41.

As shown in FIG. 2, the fastening portion 51 has a through hole 52, the inner diameter of which is larger than the outer diameters of the second cylindrical walls 36, 41. Accordingly, a substantially cylindrical clearance 53 is provided between the outer peripheral surfaces of the second cylindrical walls 36, 41 and the inner peripheral surface of the through hole 52. Therefore, the coil unit 45 is slidable in its radial direction, particularly, in a longitudinal direction (X in FIG. 6) of the casing 21 and a direction (Y in FIG. 6) perpendicular to the longitudinal direction on the two-dimensional plane inside the casing 21. Moreover, the coil support portion 48 and the ignition coil 46 are electrically connected. Further, a wire harness 54, which is electrically connected with an ignition circuit (not shown), is electrically connected to the coil support 49.

Inside the casing 21, the coil units 45 are positioned so that the pitches among the ignition coils 46 correspond to those of the spark plugs 14, i.e., the plug receiving holes 11. A bolt 55, having a non-threaded shaft 57 and a male-threaded shaft 56, is penetrated through a bolt hole 61 of the upper bushing 34 and a bolt hole 62 of the lower bushing 38. Moreover the shaft portion 56 is engaged with a female-threaded bolt hole 12 formed in the cylinder block 10. This process is similarly performed in the other three coil units 45. In this way, the coil units 45 are fixed inside the casing 21, and simultaneously the casing 21 and the coil units 45 are fastened on the cylinder block 10.

The positional adjustment of the coil units 45 inside the casing 21 is performed as follow.

At first, the casing cover 26 is detached from the casing main body 24, and the coil support portions 48 are arranged inside the casing main body 24 from the opening (lower side in FIG. 1) of the casing 21. In this state, the upper surface of each coil support 49 faces the corresponding projection 27, and the upper surface of each fastening portion 51 faces the upper bushing 34. After this process, the casing cover 26 is assembled to the casing main body 24 so that the ignition coils 46 are respectively inserted in the through holes 28 of the casing cover 26. In this instance, the lower bushings 38 respectively face the lower surfaces of the fastening portions 51, and the projections 27 press corresponding coil supports 49 downward, respectively.

Secondly, by inserting the ignition coils 46 in the plug receiving holes 11 respectively, the casing 21 is placed on the cylinder block 10, so that the lower bushing 38 is positioned on the bolt hole 12. After that, each bolt 55 is inserted through the corresponding upper bushing 34 and the corresponding lower bushing 38. The male-threaded portion 56 of the bolt 55 is engaged halfway with the corresponding bolt hole 12. In this process, in case the pitches among the coil units 45 and those among the plug receiving holes 11 are different, the coil units 45 can be slid in their radial directions by virtue of the cylindrical clearances 53.

Thirdly, the male-threaded portion 56 of each bolt 55 is tightly engaged with the corresponding bolt hole 12. Accordingly, each fastening portion 51 is clamped between the corresponding first cylindrical walls 35, 39, and the casing 21 and the respective coil units 45 are fastened to the cylinder block 10.

The integrated coil supporting unit 20 according to the first embodiment has the following advantages.

First, easily and surely, the coil units 45 can be positionally adjusted in two-dimensional directions (X and Y) inside the casing 21 by virtue of the cylindrical clearances 53. In addition, the second cylindrical walls 36, 41 and the fastening portions 51 can be formed with sufficient thicknesses, so they are less likely to be broken.

Moreover, the casing 21 has a simple structure, specifically, the projections 27 and the upper bushings 34 are formed on the upper wall 22, and the casing cover 26 has the through holes 28 and the lower bushings 38. Therefore, the shapes of mold tools for molding the casing 21 with resin can be simplified, and thereby the manufacturing cost can be lowered.

Moreover, the fastening portion 51 of each ignition coil unit 45 is clamped between the corresponding first cylindrical walls 35, 39, and the casing 21 and the coil units 45 are integrally fastened to the cylinder block 10 by means of the bolts 55. Therefore, the coil units 45 can be surely fixed inside the casing 21, and the casing 21 and the coil units 45 can be surely fastened to the cylinder block 10. Further, the bolts 55 serve as fastening members for fastening the coil units 45 to the casing 21 and for fastening the casing 21 to the cylinder block 10. That is, the required fastening members can be reduced.

(First Modification)

Figure 3:
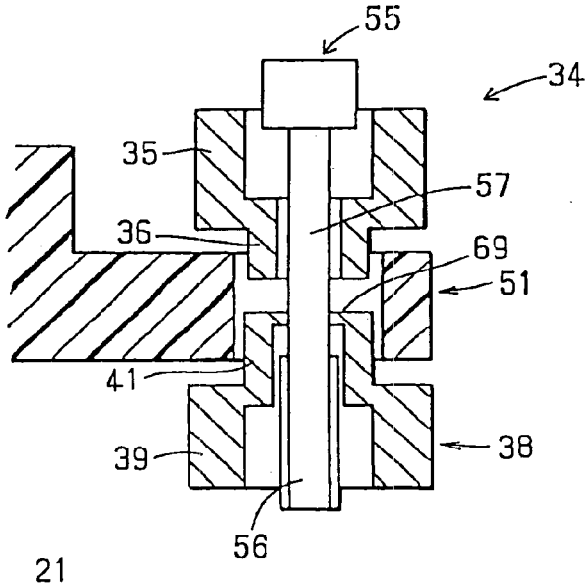
FIG. 3 is an enlarged cross-sectional view of a part of an integrated coil supporting unit according to the first modification of the first embodiment of the present invention.

An integrated coil supporting unit according to the first modification of the first embodiment is shown in FIG. 3. Components similar to those described in the first embodiment will be indicated by the similar numerals, and thus will not be described further. In this integrated coil supporting unit 20, the second cylindrical wall 41 has a circular detachment stopper portion 69 in its inner periphery. The inner diameter of the detachment stopper portion 69 is larger than the outer diameter of the non-threaded shaft portion 57 of the bolt 55 and smaller than the outer diameter of the male-threaded shaft portion 56 of the bolt 55. Accordingly, while the coil units 45 and the casing 21 are attached to the cylinder block 10, the bolts 55 are prevented from being detached from the casing 21.

(Second Modification)

Figure 4:
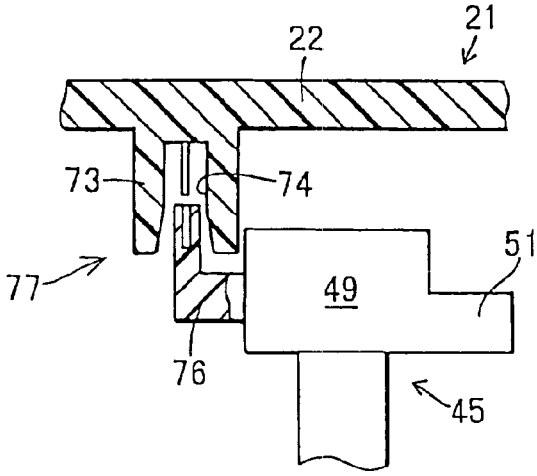
FIG. 4 is an enlarged cross-sectional view of a part of an integrated coil supporting unit according to the second modification of the first embodiment of the present invention.

An integrated coil supporting unit according to the second modification of the first embodiment is shown in FIG. 4. Components similar to those described in the first embodiment will be indicated by the similar numerals, and thus will not be described further. Harness connector units 77 are provided inside the casing 21. The harness connector unit 77 includes a female harness connector 73, which is formed on the upper wall 22 and projects downward therefrom, and a male harness connector 76, which projects from the coil support 49 toward the female harness connector 73. The female harness connector 73 has a connector hole 74 to receive the male harness connector 76. The inner diameter or size of the connector hole 74 is larger than the outer diameter or size of the male harness connector 76. Accordingly, the coil unit 45 can be easily slid in its radial direction with the male harness connector 76 fitted in the connector hole 74.

(Second Embodiment)

Figure 5A:
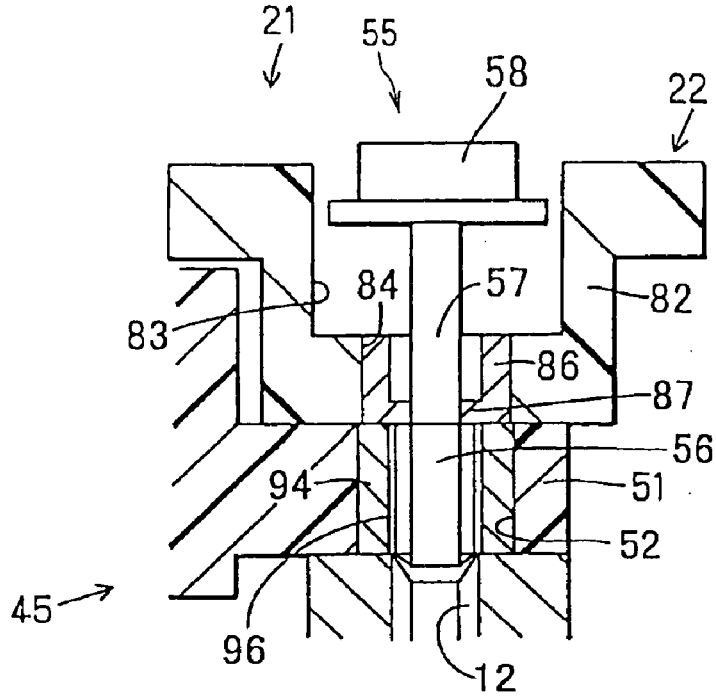
FIGS. 5A and 5B are enlarged cross-sectional views of a part of an integrated coil supporting unit according to the second embodiment of the present invention.
Figure 5B:
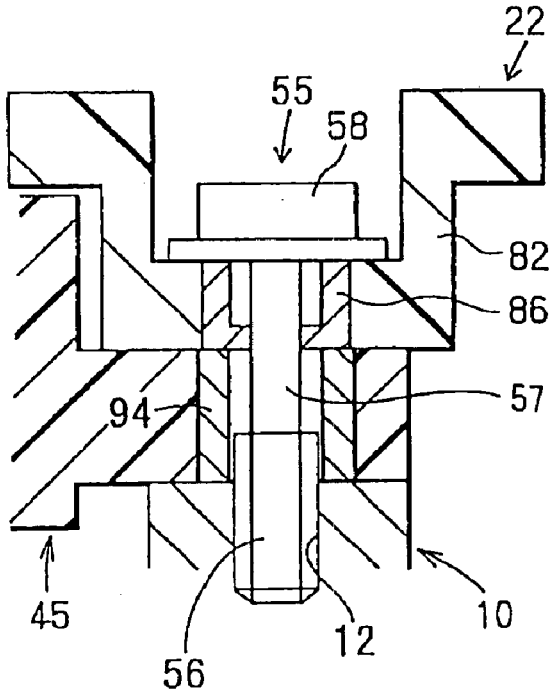
Figure 7A:
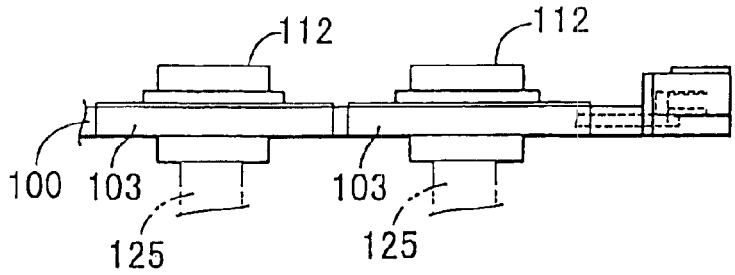
FIG. 7A PRIOR ART
FIG. 7A is a side view of a part of an integrated coil supporting unit according to the prior art.
Figure 7B:
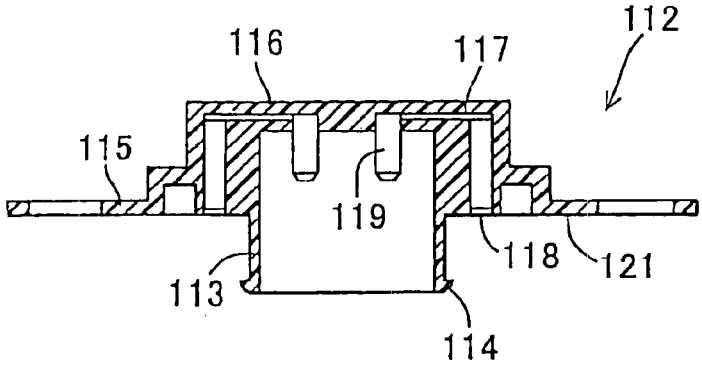
FIG. 7B PRIOR ART
FIG. 7B is a cross-sectional view of a coil connector of the integrated coil supporting unit according to the prior art.
Figure 7C:
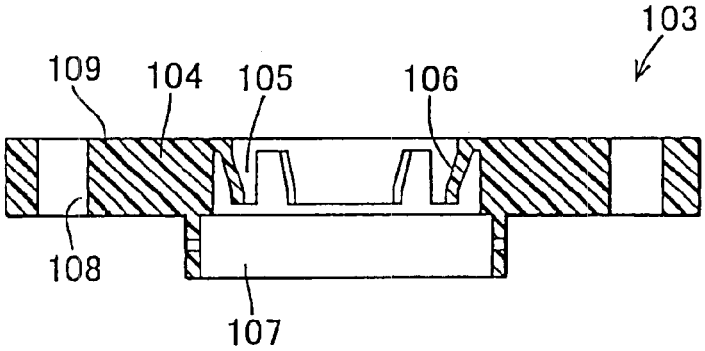
FIG. 7C PRIOR ART
FIG. 7C is a cross-sectional view of a connector support of the integrated coil supporting unit according to the prior art.
Figure 7D:
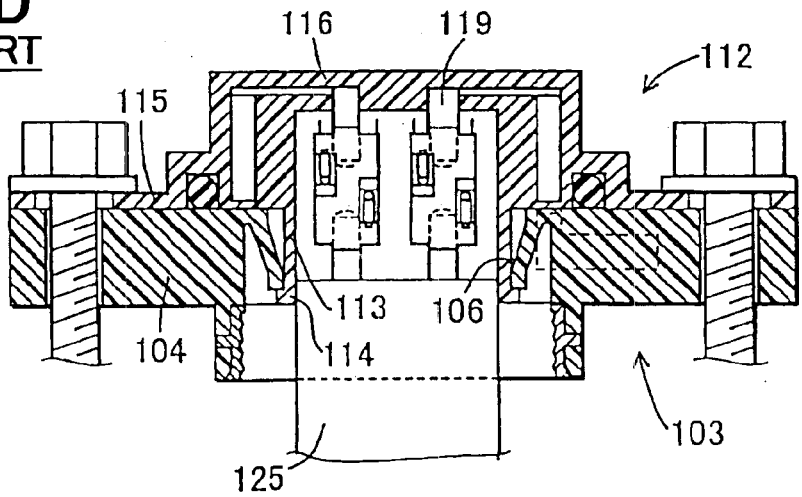
FIG. 7D PRIOR ART
FIG. 7D is a cross-sectional view of the integrated coil supporting unit according to the prior art.

An integrated coil supporting unit 20 according to the second embodiment of the present invention is shown in FIGS. 5A and 5B. Components similar to those described in the first embodiment will be indicated by the similar numerals, and thus will not be described further. In this integrated coil supporting unit, the casing 21 does not have a casing cover. The upper wall 22 of the casing 21 has a stepped portion 82 having a bolt hole 84 in its center. An upper bushing 86, having a detachment stopper 87 in its lower peripheral end, is fitted in the through hole 84. A lower bushing 94 is fitted in the through hole 52 of the coil unit 45. The inner diameter of the through hole 52 is the same as that of the through hole 84, and the inner diameter of the lower bushing 94 is the same as that of the upper bushing 86.

As shown in FIG. 5B, the shaft portions 56, 57 of the bolt 55 are penetrated through the upper bushing 86 and the lower bushing 94. The male-threaded shaft portion 56 is threadably engaged with the female-threaded bolt hole 12 in the cylinder block 10. In this state, a head portion 58 of the bolt 55 is fixed on the upper surface of the stepped portion 82.

In this integrated coil supporting unit 20, the upper end of the male-threaded shaft portion 56 is locked by the detachment stopper 87, so the bolt 55 is prevented from being detached from the casing 21. Moreover, as shown in FIG. 5A, a cylindrical clearance 96 is provided between the inner peripheral surface of the lower bushing 94 and the male-threaded shaft portion 56. Accordingly, the coil unit 45 is slidable in its radial direction, that is, both X and Y directions two-dimensionally.

Moreover, since the casing cover is not provided, the structure of the casing 21 can be simplified, and thereby the manufacturing cost can be lowered.

The present invention should not be limited to the embodiments previously discussed and shown in the figures, but may be implemented in various ways without departing from the spirit of the invention.

What is claimed is:

1. An integrated coil supporting unit for an engine including an engine block, the integrated coil supporting unit comprising:

a casing having an elongated shape;

a plurality of coil units, each of which includes;

an ignition coil; and a coil support portion, which is integrated with the ignition coil and supports the ignition coil inside the casing, wherein the coil support portions are disposed inside the casing at predetermined intervals, and each ignition coil extends from the corresponding coil support portion toward an outside of the casing;

a plurality of slide admissive means, each of which is provided for the corresponding coil unit to allow the coil unit to slide in all directions on a two-dimensional plane along which casing extends; and a plurality of fastening members, each of which positionally fixes the corresponding coil unit at a predetermined position in the casing and simultaneously fastens the corresponding coil unit and the casing to the engine.

2. The integrated coil supporting unit as in claim 1, wherein:

each slide admissive means includes a projecting portion, which projects from the casing into an inside of the casing, and a fastening portion, which is formed in the coil support portion and has a through hole penetrating through the fastening portion; and the projecting portion is disposed in the through hole with a clearance therebetween, thereby to allow the coil unit to slide on the two-dimensional plane along which the casing extends.

3. The integrated coil supporting unit as in claim 2, wherein:

the casing includes a first wall, a second wall and a pair of side walls facing each other, the first wall and the second wall facing each other;

each slide admissive means further includes an another projecting portion, which projects from the casing;

the projecting portion is formed on the first wall, and the another projecting portion is formed on the second wall; and the another projecting portion is disposed in the through hole with a clearance therebetween so as to allow the coil unit to slide.

4. The integrated coil supporting unit as in claim 2, wherein:

the casing includes a wall and a pair of side walls facing each other; and the projecting portion corresponding to each coil unit is formed on the wall.

5. The integrated coil supporting unit as in claim 3, wherein:

the projecting portion on the first wall has a first through hole penetrating therethrough;

the projecting portion on the second wall has a second through hole penetrating therethrough; and the fastening member is engaged with the engine block through the first through hole and the second through hole.

6. The integrated coil supporting unit as in claim 5, wherein the casing has a plurality of detachment stopper means, each of which prevents the corresponding fastening member from detaching from the casing.

7. The integrated coil supporting unit as in claim 4, wherein the wall has a plurality of detachment stopper means, each of which prevents the corresponding fastening member from detaching from the casing.

8. The integrated coil supporting unit as in claim 1, wherein:

each coil unit has a first connector;

the casing has a plurality of second connectors, each of which is to be electrically connected with the first connector;

a clearance is provided between each first connector and the corresponding second connector when being connected, thereby to allow the corresponding coil unit to slide.

9. An integrated coil supporting unit for an engine including a plurality of plug holes on an engine block, the integrated coil supporting unit comprising:

a plurality of ignition units including a plurality of integrated ignition coils and spark plugs for installation in the plug holes, respectively;

a casing having an elongated shape for attachment to the engine block to cover the plug holes; and a plurality of fastening members engaged with the casing and the ignition units, respectively, for holding the casing and the ignition units integrally and fastening the casing to the engine block together with the ignition units, wherein each of the ignition units has an extension part extending radially outward from a corresponding ignition coil so that the fastening members are engaged with the engine block at locations radially outside the plug holes, respectively, and wherein the extension part has a through-hole that is larger in diameter than a corresponding fastening member thereby to allow the corresponding ignition unit to move in a radial direction of a corresponding fastening member.

10. The integrated coil supporting unit as in claim 9, wherein:

the casing is box-shaped and has a pair of projections for each extension part to sandwich the extension part in the casing and engage with the corresponding fastening member.

* * * * *